US007585381B1

(12) United States Patent
Zubrin

(10) Patent No.: US 7,585,381 B1
(45) Date of Patent: Sep. 8, 2009

(54) NITROUS OXIDE BASED EXPLOSIVES AND METHODS FOR MAKING SAME

(75) Inventor: Robert M. Zubrin, Indian Hills, CO (US)

(73) Assignee: Pioneer Astronautics, Lakewood, CO (US)

( * ) Notice: Subject to any disclaimer, the term of this patent is extended or adjusted under 35 U.S.C. 154(b) by 154 days.

(21) Appl. No.: 10/913,990

(22) Filed: Aug. 6, 2004

Related U.S. Application Data

(60) Provisional application No. 60/494,051, filed on Aug. 7, 2003.

(51) Int. Cl.
*C06B 47/00* (2006.01)
*C06B 45/00* (2006.01)
*C06B 47/04* (2006.01)

(52) U.S. Cl. ..... 149/1; 149/2; 149/74

(58) Field of Classification Search ..... 149/1, 149/2, 74

See application file for complete search history.

(56) References Cited

U.S. PATENT DOCUMENTS 2,273,166 A * 2/1942 Allen ..... 102/382
3,291,463 A * 12/1966 Rousseau et al. ..... 261/100
3,955,509 A * 5/1976 Carlson ..... 102/363
4,902,539 A * 2/1990 Jackson ..... 427/446
5,014,623 A * 5/1991 Walker et al. ..... 102/477
6,269,746 B1 * 8/2001 Larsen ..... 102/262
6,607,567 B1 * 8/2003 Towfighi ..... 44/448
2002/0092290 A1 * 7/2002 Herdy, Jr. ..... 60/218

* cited by examiner

*Primary Examiner*—Michael A Marcheschi
*Assistant Examiner*—James E McDonough
(74) *Attorney, Agent, or Firm*—Swanson & Bratschun L.L.C.

(57) ABSTRACT

An explosive device and methods for forming same, the device comprising a portion of nitrous oxide and a portion of fuel. In one example, the explosive device may include a first storage area containing said portion of nitrous oxide, and a second storage area containing said portion of fuel, wherein the first storage area selectively maintains the portion of nitrous oxide separated from the fuel in the second storage area prior to detonation of the explosive device. In another example, in the event the explosive fails to detonate, the explosive device may include a vent valve for discharging the nitrous oxide from the explosive device to reduce or eliminate its explosive characteristics. The explosive device can be used for various applications, including but not limited to military weapons, pyrotechnic devices, or civil blasting explosives, for example.

18 Claims, 3 Drawing Sheets

NITROUS OXIDE BASED EXPLOSIVES AND METHODS FOR MAKING SAME

CROSS-REFERENCE TO RELATED APPLICATION

This application claims priority under 35 U.S.C. 119(e) to U.S. Provisional Patent Application No. 60/494,051 entitled "NITROUS OXIDE BASED EXPLOSIVES" filed Aug. 7, 2003, the disclosure of which is hereby incorporated by reference in its entirety.

FIELD OF THE INVENTION

This invention relates, in general, to explosives, munitions, bombs, weapons, and blasting equipment.

BACKGROUND

Conventional explosives present many hazards to both military personnel and civilians from the time they are manufactured until the initiation of operations. The ammunition factory, the trucks or trains transporting the explosives from the factory to the seaport or airport of debarkation, the airplanes or ships that are used to transport munitions overseas, the ground transportation used to move the ammunition from the port of arrival to overseas military bases, and the ammunition dumps in the destination country, are all points of vulnerability that can lead to potential disaster.

Ever since gunpowder has been employed in warfare, experience has repeatedly shown the hazard to armed forces of their own ammunition, with notable incidents ranging from the explosion of the Venetian magazine on the Acropolis during the 17th century Turkish siege of Athens, the loss of some 1000 American sailors when a string of ammunition ships exploded off Hawaii in 1944, to the detonation of a US ammo dump in Baghdad in May 2003. This danger is particularly great under conditions such as the current period of unsymmetrical warfare, where an enemy whose limited firepower provides a strong incentive to use an armed forces' own weapons against them. For instance, by hitting an ammunition dump, a terrorist can destroy a military base or a town.

Further, throughout history, numerous major warships, such as the HMS Hood, have been lost in combat when a single hit ignited their magazines, and land-based artillery batteries and bombers in flight have been destroyed in similar fashion.

Moreover, one of the major hazards of modern warfare is the large amount of unexploded bombs, mines, and other ordnance that litter the war zone after conflict is over. The elimination of such unexploded weapons is an extremely dangerous and expensive task.

Hence, as recognized by the present inventor, what is needed is an explosive device that is not explosive during storage or prior to deployment, and is explosive during deployment or use. It is against this background that various embodiments of the present invention have been developed.

SUMMARY

In light of the above and according to one broad aspect of one embodiment of the present invention, disclosed herein is an explosive formed using at least two portions, a portion of nitrous oxide ($N_2O$) and a portion of fuel. In one example, these two portions of the explosive are maintained apart (i.e., physically and chemically isolated or separated) from one another until the explosive is to be detonated.

In one example, the nitrous oxide is preferably in liquid form, and the fuel may be an organic liquid (such as, for example, liquid propane, liquid ethanol, gasoline, kerosene, benzene, etc.) or a powdered metal or other solid (such as, for example, magnesium, aluminum, polyethylene, or graphite). When uncombined, both $N_2O$ and the fuel portions are separately stable; however, when combined under moderate pressure, the mixture is highly explosive. Hence, an explosive may be controllably filled with the first portion and the second portion using a timer valve or other mechanism so that the explosive mixture is not formed until prior to impact, spark ignition or other means of detonation. In one example at delivery, the mixture is ignited by spark or shock and the explosive device detonates.

Such explosives can be safer than conventional explosives, and depending upon the implementation, can yield an explosive force greater than TNT. One advantage of explosive devices made according to embodiment of the present invention is that any enemy strike or other action that hit stored munitions (having been made using embodiments of the present invention) on the ground, in ships, or in aircraft—will be less dangerous since the stored munitions are not explosive until the mixture is formed.

In addition, embodiments of the present invention can be formed such that unexploded bombs are self-disarming through the use of one or more small vent valves in the bomb. In one example, because $N_2O$ is pressurized within the bomb, the vent valve permits the $N_2O$ to escape over a period of time in the absence of detonation. Such a system can make post-combat clean up operations of unexploded bombs simpler and safer.

According to another broad aspect of an embodiment of the present invention, disclosed herein is an explosive device comprising a portion of nitrous oxide and a portion of fuel. In one example, the explosive device may also include a first storage area containing the portion of nitrous oxide, and a second storage area containing the portion of fuel, wherein the first storage area selectively maintains the portion of nitrous oxide separated from the fuel in the second storage area prior to detonation of the explosive device.

In another example, the explosive device may also include means for mixing the portion of nitrous oxide with the portion of fuel to form an explosive mixture. In one example, the means for mixing many include a conduit fluidly coupling the first and second storage areas, and a normally closed valve positioned within the conduit. Prior to detonation of the explosive, the valve can be opened to allow mixing of the nitrous oxide with the fuel to form an explosive composition or mixture. In another example, the means for mixing includes a rupturable membrane positioned between the first and second storage areas, and the rupturable membrane breaks to mix the nitrous oxide with the fuel.

The nitrous oxide and fuels can be stored in various storage areas or vessels within the explosive device, such as containers, tanks, reservoirs, enclosures, fluid packages, bladders, or other conventional containers.

In one example, the portion of fuel includes a liquid fuel selected from alcohols, paraffins, olefins, aromatics and mixtures thereof, or a solid fuel selected from powdered graphite, plastics, metals and mixtures thereof. In one example, the nitrous oxide is stored as a liquid in the first storage area, and may be stored under pressure or otherwise pressurized when mixed with the fuel.

In another example, the explosive device may include a vent valve for discharging the nitrous oxide from the explosive device, so thereby discharging the explosive device to reduce or eliminate its explosive characteristics.

The explosive device can be used for various applications, including but not limited to military weapons, pyrotechnic devices, or civil blasting explosives, for example.

According to a broad aspect of another embodiment of the present invention, disclosed herein is a method for forming an explosive device. In one example, the method includes storing nitrous oxide in a first storage area; storing fuel in a second storage area, the fuel being chemically isolated from the nitrous oxide; and mixing the nitrous oxide and the fuel prior to detonating the explosive device. The operations of storing the nitrous oxide and storing the fuel in the explosive device can be performed at different times, such as minutes apart, hours apart, or even months or years apart. The operation of mixing the nitrous oxide and the fuel can occur before deployment of the explosive, as the device is deployed, or after the device is deployed.

According to another broad aspect of another embodiment of the present invention, disclosed herein is a composition for use as an explosive which comprises a fuel and nitrous oxide, wherein the ratio of fuel:nitrous oxide is from about 5:1 to about 1:100 by weight. In one example, the composition may include a liquid fuel selected from alcohols, paraffins, olefins, aromatics and mixtures thereof, or a solid fuel selected from powdered graphite, plastics, metals and mixtures thereof. The nitrous oxide may be in the form a gas or a liquid under high pressure, in one example.

The features, utilities and advantages of the various embodiments of the invention will be apparent from the following more particular description of embodiments of the invention as illustrated in the accompanying drawings.

DETAILED DESCRIPTION

Figure 1:
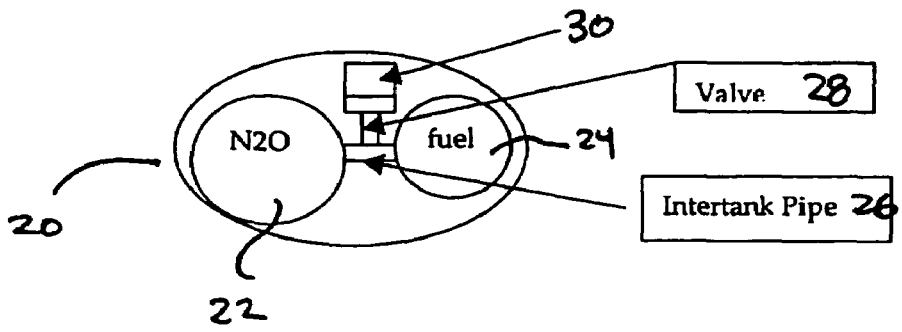
FIG. 1 illustrates an example of an explosive device, in accordance with an embodiment of the present invention.

Disclosed herein is an explosive formed using at least two portions, a portion of nitrous oxide ($N_2O$) and a portion of fuel. In one example, these two portions of the explosive are maintained apart (i.e., physically and chemically separated or isolated) from one another until the explosive is to be detonated. The nitrous oxide and fuel can be introduced into the explosive at different times, such as minutes apart, hours apart, or even days, months or years apart. These chemical components can be stored within storage areas, tanks, containers, vessels, reservoirs, enclosures, or other convention storage structures within the explosive (these terms are used interchangeably herein). In one example, the nitrous oxide and the fuel can be mixed or combined before detonation of the device, such as before deployment of the explosive, as the device is deployed, after the device is deployed. The explosive device can be used for various applications, including but not limited to military weapons, pyrotechnic devices, or civil blasting explosives, for example. Various embodiments of the present invention will now be described.

Nitrous oxide, $N_2O$, is a non-toxic chemical that has been in common use as a dental anesthetic since the 1840's. It is an endothermic molecule, which releases 19 kcal/mole when it breaks down. However, $N_2O$ does not decay at room temperature, and the material can be stored for years in steel, aluminum, or composite bottles. $N_2O$ can be stored as a liquid with a density of 700 kg/m$^3$ at 20 C and 700 psi pressure, or 900 kg/m$^3$ at 0 C and 500 psi pressure, which means that about 20 times as much $N_2O$ can be put in a tank of a given mass than compressed air, which stores at 250 kg/m$^3$ at 3000 psi. $N_2O$ is handled safely every day without incident in large quantities, for example by dental assistants and racecar drivers.

As recognized by the inventor, $N_2O$ is miscible or combinable with all olefins, paraffins, and alcohols up to at least C12. It is also miscible with many aromatics, including benzene and toluene. In one example, a fuel, such as ethanol, propane, hexane, or toluene, is first introduced, and then pressurized liquid $N_2O$ is added to form the explosive. Under these conditions, experiments conducted by the inventor show that these mixtures or compositions become high explosive. The mixtures can be pressurized to several hundred psi, so that the $N_2O$ stays liquid. To dispose of the explosive, the pressurized $N_2O$ can be vented and the $N_2O$ will evaporate.

An example of a pressurized mixture or composition of liquid propane and liquid nitrous oxide is now described (the terms mixture and composition are used interchangeably herein). The two components are completely miscible. The stoichiometric reaction between the two components is given by:

$$C_3H_8+10N_2O \Rightarrow 10N_2+3CO_2+4H_2O \quad \Delta H=-2646 \text{ kJ/mole}$$

The total molecular weight of the reactants in this example is 484, meaning the energy yield of the reaction is 5.47 MJ/kg. For purposes of comparison, TNT has an energy yield of approximately 2.9 MJ/kg. In other words, nitrous/propane offers almost twice (a factor of 1.89) the yield of TNT per unit mass. TNT is about twice as dense as the $N_2O$/propane mixture (at 0 degrees C.) so in terms of yield per unit volume, they are about the same.

It will be observed that the mixture ratio may be heavily weighted towards $N_2O$, in the previous example for instance, 10:1 nitrous/propane by weight. However, a range of nitrous/propane ratios by weight provide sufficient energy yield for use in embodiments of the present invention, for example, a ratio of 100/1 to 1/5, and preferably from 20/1 to 5/1, could be used. It is understood that other ratios, either within or outside of this range, could be used depending upon the implementation.

The yield of nitrous in combination with several different fuels is given in Table 1. TNT is presented for comparison. Options shown include combining $N_2O$ with various liquid fuels including alcohols, paraffins, olefins, and aromatics, as well as solid fuels, including powdered graphite, plastics, and various metals, or any substance which releases energy upon reaction with oxygen. For example, propane, polyethylene, graphite, and powdered magnesium may all be considered fuels. It should be understood that these examples are illustrative of a vast number of alternative combinations involving mixing $N_2O$ with any kind of combustible fuel and the examples are not intended to limit the scope of the invention.

It can be seen from the examples in Table 1 that the explosive yield obtainable from mixing $N_2O$ with various fuels can range from 60% to more than 300% greater than those obtainable from the same unit mass of TNT.

TABLE 1

Yield of Explosive Mixtures

| Mixture | Yield | Yield vs. TNT |
|---|---|---|
| TNT | 2.90 MJ/kg | 1.000 |
| $N_2O$/Ethanol ($C_2H_5OH$) | 4.71 | 1.624 |
| $N_2O$/Propane ($C_3H_8$) | 5.47 | 1.886 |
| $N_2O$/Octane ($C_8H_{18}$) | 5.76 | 1.986 |
| $N_2O$/Benzene ($C_6H_6$) | 5.80 | 2.000 |
| $N_2O$/Propylene ($C_3H_6$) | 5.94 | 2.048 |
| $N_2O$/C | 5.54 | 1.910 |
| $N_2O$/polyethylene ($C_nH_{2n}$) | 5.72 | 1.972 |
| $N_2O$/Si | 8.80 | 3.034 |
| $N_2O$/Mg | 9.81 | 3.383 |
| $N_2O$/Al | 10.06 | 3.469 |
| $N_2O$/Li | 11.66 | 4.021 |

$N_2O$ mixtures or compositions of the present invention are safer than standard explosives because the fuel and oxidizer are kept separate until shortly before munition delivery, deployment, or detonation. Bombs could be transported overseas with fuel and oxidizer in separate tanks, or just one of the fluids, or even transported empty and only filled with both fluids shortly before the munitions are loaded onto an aircraft for a combat mission. In one example, the fluids are not allowed to mix until the bomb is released from the aircraft. At time of release, a small slow-leak valve on the munition can be open to act as a failsafe, where $N_2O$ will leak completely out of the munition over time. This would ensure that unexploded munitions of the present invention would vent their entire explosive within a few hours after landing. If a mission were aborted, the aircraft could vent its bombs, or fly home and have the unmixed fluids drained.

For purposes of creating explosives with maximum yield per unit weight, one example of stoichiometry will be that which provides enough $N_2O$ to react its oxygen content with all of the fuel. In the case of the propane/$N_2O$ explosive example discussed above, this will be 1 part by weight propane to 10 parts $N_2O$. In the case of a Mg/$N_2O$ mixture, one example of a ratio would be 6 parts Mg to 11 parts $N_2O$. However, in experiments done by the inventor, it was found that mixtures of hydrocarbons with $N_2O$ would still detonate even if either the fuel or the nitrous was present in quantities exceeding the ideal stoichiometric value by many times (in some cases as much as 20 times). In certain applications, altering the stoichiometry in this way may be desirable. For example, instead of mixing the ideal stoichiometric ratio for combustion of one part propane with 10 parts $N_2O$, it may be desirable in certain military applications such as an incendiary bomb to mix five parts propane with 10 parts of $N_2O$. This fuel-rich mixture will still be highly explosive, however there will be a residue of 4 parts propane which will burn in air. The total mass of the bomb's reactants will only increase by a factor of 15/11 (1.36), but the net energy yield will be almost quadrupled. Alternatively, one could have a 1/10 mixture of propane/$N_2O$ residing in a sponge of aluminum or magnesium. The propane/$N_2O$ mixture will detonate with great force, spreading the metal fragments to burn in air at very high temperatures. Alternatively, if the target is one which itself contains a great deal of combustible fuel material, it might be advantageous to employ explosives or bombs of the present invention in which $N_2O$ is present in amounts exceeding stoichiometric combustion ratios.

In principle, it is possible to construct explosives using such alternative oxidizers as liquid oxygen, hydrogen peroxide, or $N_2O_4$. However liquid oxygen requires storage at cryogenic temperatures, hydrogen peroxide is unstable and prone to both slow deterioration and catastrophic detonation, and $N_2O_4$ is extremely toxic. For these reason, these alternative oxidizers have serious operational disadvantages compared to $N_2O$, which is stable, non-toxic, and storable as a liquid under 700 psi pressure at room temperature. However, for purposes of the present invention, it is envisioned that liquid oxygen, hydrogen peroxide of $N_2O_4$ can replace $N_2O$ or be combined with $N_2O$ in the fabrication and use of the present explosive devices.

Applications of nitrous oxide based explosives of embodiments of the present invention include all areas of explosive weaponry, such as bombs, shells, missiles, and mines. In addition, embodiments of the present invention can also be used to provide propulsion for all kinds of projectile weapons, for example, ranging from small arms to heavy artillery. Embodiments of the present invention can also be combined with missile systems propelled by monopropellant, bipropellant, or hybrid rockets employing $N_2O$ as an oxidizer to provide such systems with both propulsion and armament from a common reservoir. Embodiments of the present invention can also be used for civil applications, such as mining, blasting, and demolition work, as well as to support fireworks displays and other pyrotechnic applications.

There are numerous applications in which embodiments of the present invention may be used. For instance, devices can be formed involving slow mixing of explosive components, those requiring fast mixing of explosives, those involving synergy between explosive formation and rocket propulsion, and those used for gun applications. These examples will now be discussed.

In slow mixing applications, there is generally no time urgency between the deployment of the device and the achievement of intimate mixing of the binary explosive components. Such applications may include mining and demolition work and other kinds of civilian blasting, use of explosives of the present invention in land mines or sea mines, and use of explosives of the present invention in military munitions where it is assumed that the mixing can be allowed to start some period of time before detonation of the weapon. Thus, for example, if it is deemed acceptable that the binary components of a bomb of the present invention be allowed to start mixing while the bomber is still 30 minutes away from the target, a slow mixing device can be used. However if the initiation of mixing is forbidden until after the bomb is dropped, then a fast mixing system, described below, can be used.

Because time is available for mixing by natural diffusion, slow mixing systems can be formed without the need for mechanical systems to force the mixing process. In one example, the liquid fuel is provided in one tank, and the $N_2O$ is provided in another tank, and one or more pipes connecting them with valves therebetween. Prior to deployment, the valves separating the two tanks are kept closed, keeping the liquids separate. When it is time to deploy, the valves are opened, either by set timer, radio command, manually or otherwise. Since they are miscible, two fluids will then slowly being to mix, eventually (perhaps after 10 minutes to an hour, depending upon the design), achieving complete homogeneity, and thus full explosive potential. A simplified drawing of such a system is shown in FIG. 1.

In FIG. 1, an explosive 20 is illustrated having a first tank 22 preferably containing $N_2O$, and a separate second tank 24 containing liquid fuel. A pipe or conduit or other fluid communication mechanism 26 is provided between the tanks, wherein a valve 28 is provided within the pipe or conduit 26, being normally closed so as to provide complete fluid separation between the nitrous oxide in the first tank 22 and the liquid fuel in the second tank 24. A valve control 30 is coupled with the valve 28 and the valve control 30 controls the state of the valve 28 (i.e., valve closed or valve opened). The valve control 30 can include a timer, a wireless or radio communication link or other conventional communication components for receiving external control signals to open or close the valve 28, a micro controller or microprocessor or other logic for controlling the valve state. In one example, the valve control 30 controllably opens the valve 28 so that the nitrous oxide from the first tank 22 and the liquid fuel from the second tank 24 can mix. The rate at which these components mix may be controlled, in part, by the physical characteristics of the pipe or conduit 26 (i.e., the dimensions or physical structure of the conduit 26), the degree to which the valve 28 is open (i.e., for instance the valve control 30 may open the valve 28 to a certain degree, such as 10% or 15% or other percent open) so as to achieve a desired flow rate between the first tank 22 and the second tank 24.

Fast mixing systems or applications of the present invention can be used when only a short time is available between initiation of mixing and the detonation of the explosion. Such a situation may occur in the case of bombs, torpedoes, depth charges, missiles or long range artillery shells of the present invention where the application requires that no mixing be allowed until after the weapon is dropped, launched, or fired. For example, only a minute or less might be available for mixing to occur, and so features can be added to the explosive device to assure such rapid mixing. In one example, such systems can include a rupturable membrane separating the two fluids, although other options are possible. Several examples of fast mixing systems of the present invention are shown in FIGS. 2-4.

Figure 2:
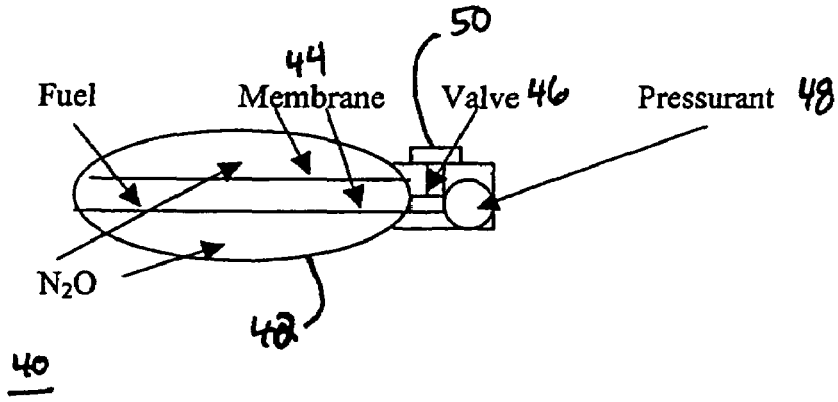
FIG. 2 illustrates another example of an explosive device, in accordance with an embodiment of the present invention.

In FIG. 2, a system according to one example of the present invention is shown, in which the liquid fuel is kept separate from the $N_2O$ oxidizer by a rupturable membrane or fluid barrier. In FIG. 2, an explosive 40 is illustrated having a tank 42 with a rupturable membrane or fluid-type package 44 within the tank 42. Preferably, the liquid fuel may be stored within the membrane or fluid-type package 44 which is positioned within the tank 42. Outside of the membrane or fluid-type package 44, nitrous oxide is stored within the tank 42. Accordingly, the tank 42 contains both nitrous oxide and liquid fuel; however, both components are maintained fluidly separate due to the nature of the rupturable membrane 44. In one example, the rupturable membrane 44 is coupled through a normally closed valve 46 with a pressurant 48 that includes high pressure gas. A valve control 50 may electromechanically control the state of the valve 46, and may include a micro controller or other logic, as well as components for receiving wireless communication or radio communication signals, in one example.

When it is time to start mixing, a valve 46 is opened allowing high-pressure gas 48 to pressurize the fuel inside the membrane 44. The pressurized fuel breaks the membrane 44 and is exposed to immediate intimate mixing with the surrounding $N_2O$. Numerous variations of this example are possible, including changing the geometry, pressurizing the $N_2O$ instead of the fuel, or using a gas generating chemical reaction to create the pressure instead of a pressurant bottle 48 and valve 46. Such a system may be used for a gravity bomb dropped from a high altitude aircraft, such as a B-52. Such bombs can take as long as 45-60 seconds from release to ground strike.

Figure 3:
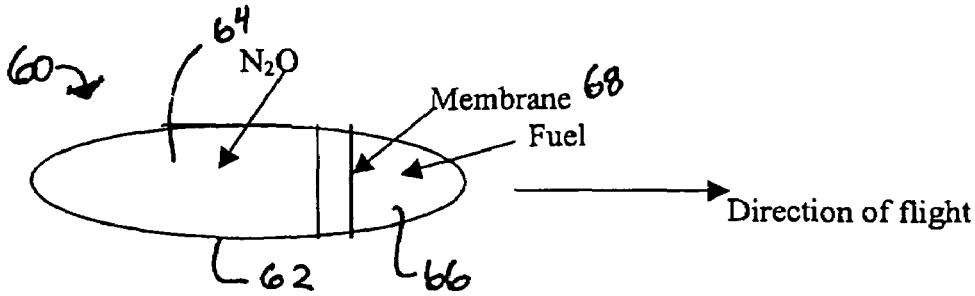
FIG. 3 illustrates another example of an explosive device, in accordance with an embodiment of the present invention.
Figure 4:
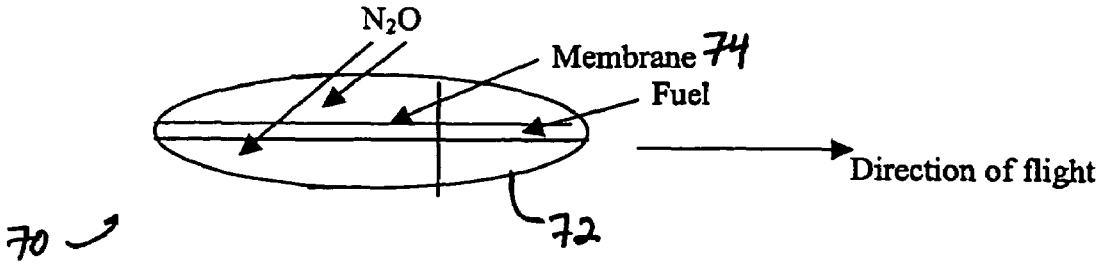
FIG. 4 illustrates another example of an explosive device, in accordance with an embodiment of the present invention.

In FIG. 3, an artillery shell of an embodiment of the invention is shown in which the liquid fuel is kept separate from the $N_2O$ oxidizer by a rupturable membrane. In FIG. 3, an explosive or munition 60 is illustrated having a shell or tank 62 with a first portion 64 for storing nitrous oxide, and a second portion 66 for storing liquid fuel, wherein the first and second portions 64, 66 are separated by a rupturable membrane 68.

When the shell 60 is fired, the massive acceleration gives the fuel above the membrane 68 sufficient weight to break the membrane 68, allowing the fuel to rapidly mix with the $N_2O$ below the ruptured membrane. Variations in geometry and arrangement are possible, including systems where the membrane 68 is a cylinder immersed within the $N_2O$, thereby preventing any splashing that might cause premature detonation. Such a system is shown in FIG. 4.

In FIG. 4, an explosive or munition 70 is illustrated having a tank or shell portion 72 within which a cylindrical rupturable membrane or package 74 containing liquid fuel is positioned or contained within the tank or shell 72, and nitrous oxide is stored also within the tank or shell 72. In FIG. 4, the positioning of the fuel in a long or axial column of the shell 72 within the $N_2O$ gives it a greater pressure head when subjected to the massive acceleration of artillery fire. Part of the cylindrical membrane 74 ruptures under the gravitational load of the accelerated fuel. With the membrane 74 gone, gravity forces the fuel to disperse itself radially into the surrounding $N_2O$, causing rapid mixing. Such systems are also possible with the positions of the $N_2O$ and the fuel reversed, provided that appropriate sizing is provided to house each of the reactants in their desired quantities.

Nitrous oxide can be used as a monopropellant or as the oxidizer in a bipropellant or hybrid rocket. It can also be used as a oxidizer in a torpedo propulsion system. In one application, the $N_2O$ for propulsion and to form a warhead using embodiments of the invention can be drawn from a common reservoir. An example of such a system is shown in FIG. 5.

Figure 5:
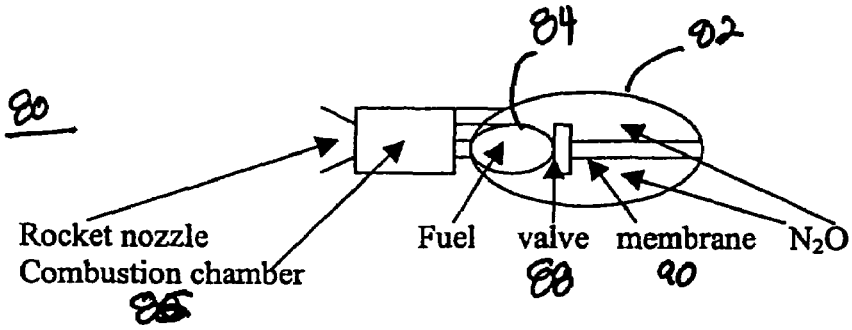
FIG. 5 illustrates another example of an explosive device, in accordance with an embodiment of the present invention.

In FIG. 5, a bipropellant rocket 80 is shown in which nitrous oxide and a liquid propellant (shown as fuel) are stored in tanks 82, 84 and fed in conventional fashion by separate lines into a combustion chamber 86. The fuel and the nitrous are pressurized by an external pressurant (not shown), like compressed helium with the fuel pressure somewhat higher than the nitrous pressure. Alternatively, the fuel could be a fluid like ethylene, which has a vapor pressure that is higher than $N_2O$. In such a case, external pressurant may not be needed, as both the $N_2O$ and the ethylene propellant tanks 82, 84 could be autogenously pressurized. In either case, after the amounts of $N_2O$ and fuel have been fed to a rocket engine 86 for the vehicle 80 to achieve its desired velocity, a valve 88 could be opened, allowing the fuel, which is at a higher pressure than the $N_2O$, to flow into the membrane 90 and burst it. The fuel and $N_2O$ then will mix, and the $N_2O$ propellant tank 82 will become a high explosive warhead. Assuming the rocket engine 86 operates at a stoichiometric mixture ratio, the fuel and $N_2O$ tanks 84, 82 will be filled to that ratio initially, and will also still be at that ratio after the fraction of each fluid required for propulsion has been used. The residual of each fluid will thus be present in the mixing ratio to create high explosive.

Similar schemes are possible for monopropellant of hybrid $N_2O$ rockets, except that in such cases the liquid fuel tank 84 would be smaller, as only enough liquid fuel needs to be carried to create the high explosive warhead, i.e. no liquid fuel is needed for propulsion.

Figure 6:
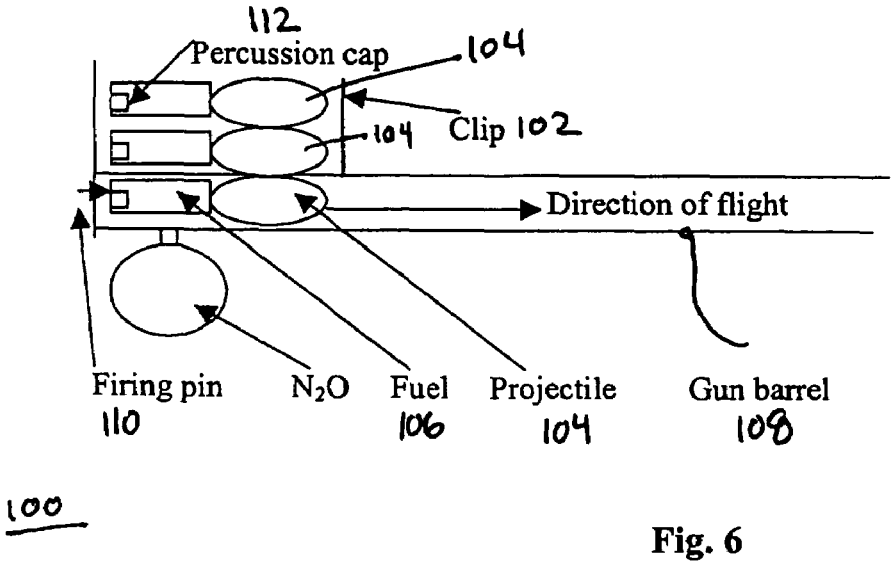
FIG. 6 illustrates an example of a weapon such as a firearm or cannon, in accordance with an embodiment of the present invention.
Figure 7:
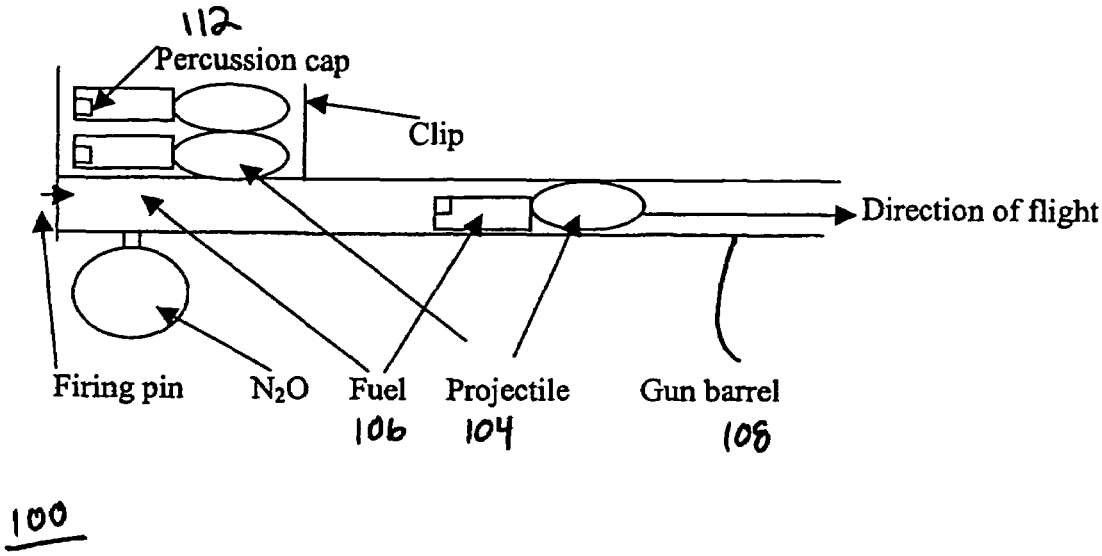
FIG. 7 illustrates another example of a weapon such as a firearm or cannon, in accordance with an embodiment of the present invention.

Explosives can also be used to propel projectiles out of guns using embodiments of the present invention. In the case of gun applications, it is generally desired that the combustion of the propellant not occur instantly, as such sudden release of energy can damage gun barrels. Instead, it is desired that the combustion should be spread out over a substantial fraction of the time it takes the projectile to move down the barrel. FIGS. 6-7 show devices according to the present invention to propel gun projectiles.

In FIG. 6, a gun or firearm 100 is shown having a clip 102 with a series of projectiles 104 attached to fuel cylinders 106, which can either be a solid, such as polyethylene, or a container 106 containing a liquid fuel. When a mechanism is activated, one of these projectile/fuel combinations 104/106 is pushed into the gun barrel chamber 108. Shortly afterward, a metered amount of $N_2O$ is squirted into the chamber 108. Then, when the gun is fired, a firing pin 110 hits a percussion cap 112 attached to the fuel cylinder 106, igniting it in conventional fashion. In the case where solid fuel is being employed, this starts a combustion reaction between the solid fuel and the $N_2O$, generating gas that propels the projectile 104 down the barrel 108. The solid fuel 106 can be shaped in various ways to increase its surface area, thereby insuring rapid, but not instantaneous combustion. Alternatively, if a liquid fuel is employed, the ignition of the percussion cap 112 creates a hole in the fuel container 106, causing the liquid fuel to leak out in to the surrounding $N_2O$, where it burns, propelling the projectile 104 down the barrel 108. In one example, the container 106 of the liquid fuel may be a combustible plastic and therefore burn up as well. After the projectile 104 is expelled from the gun, the remains of the percussion cap 112 and the fuel cartridge 106 are ejected, and another projectile/fuel cartridge combination 104/106 is inserted into the gun 100 to fire again.

In an alternative embodiment of FIG. 7, the fuel cartridge 106 remains attached to the projectile 104 as it runs down the barrel 108, burning up as it goes. In this case, acceleration forces can assist in expelling the fuel from its container 106, which has been punctured in the rear by the detonation of the percussion cap 112. This example has the advantage of eliminating the need for an ejection mechanism, thereby increasing the potential rate of fire.

In either case, the gun 100 using embodiments of the present invention offers advantages over conventional guns in that the two components of its propellant ($N_2O$ and fuel) can be stored separately, thereby reducing the hazards associated with ammunition storage. In addition, the use of liquid $N_2O$ as the propellant oxidizer has the potential to greatly reduce gun residues, thereby reducing requirements for gun cleaning.

Numerous other embodiments are possible on the examples described above. For example, it may be possible to increase the stability of explosives against accidental shock-induced detonation by mixing inert substances, such as carbon dioxide, with the $N_2O$/fuel mixtures. Alternatively, combustion can be initiated by the introduction of highly reactive substances. For example, silane (SiH4) will combust spontaneously with $N_2O$. A small amount of silane could the be introduced to a $N_2O$/fuel mixture as a way to initiate detonation. Other possibilities include systems that combine explosives of the present invention with conventional explosives. A stainless steel tube filled with a mixture of $N_2O$ and propane could be used a means of igniting a conventional explosive, or insuring that one explosion sets off another. Alternatively, small conventional explosives could be used as a means for igniting larger explosives made according to the present invention.

The use of devices made according to embodiments of the present invention in place of conventional munitions can eliminate various dangers nearly entirely. Because the two components of the explosives are not mixed until the mission is initiated, there are no stockpiles of explosives available to be triggered by attack, sabotage, or catastrophic accident. Manufactured separately, transported separately, and stored separately, the separate chemical components represent a negligible hazard compared to that presented by conventional high explosives.

Systems made according to embodiments of the present invention can greatly increase the safety of armed forces and other users during active operations. A warship or other unit using ammunition according to embodiments of the present invention would not have such a point of catastrophic vulnerability. In the case of long range (~20 mile) artillery, missiles, torpedoes, depth charges, mines, and high altitude bombers, the time between gunfire or weapon release and impact is sufficiently long (>1 minute) that the two components of the device made according to embodiments of the present invention can be allowed to mix in transit, thereby eliminating the need to store live ammunition on the warship, aircraft, minelayer, or gun battery itself. Even in the case of short range, short flight-time weapons, the large majority of the ammunition can be stored in passive, unmixed form, and only the handful of shells that will be fired over the next minute made active at any one time.

When used in a civilian context, systems made according to embodiments of the present invention also offer much greater safety than conventional explosives. For example miners, demolition personnel and others could handle and place the device in passive form where it is needed, and then get far away before a timer or remote control device allows the two components of the explosive to mix just prior to detonation. Thus civilian personnel will not need to handle live explosives during any phase of the blasting operation.

The use of weapons made according to embodiments of the present invention could greatly ameliorate the dangers of unexploded bombs. Because $N_2O$ either by itself, or when mixed with organic liquid is highly volatile, all that is needed to safely dispose of an unexploded device is to open a valve and let the explosive fluid evaporate. This could be done autonomously by a timer attached to the weapon set to release the fluid a set time after deployment. Depending upon the weapon, this amount of time could range from minutes (in the case of bombs or shells) to months (in the case of mines) or longer. Alternatively, the release of the explosive fluid to deactivate the weapon could be made to occur upon order by properly coded radio remote control, or be done manually. Furthermore, there would be no need to take the weapon somewhere else and explode it, as it would be completely safe once the fluid was allowed to evaporate.

It can be seen from Table 1 that devices made according to embodiments of the present invention offer 1.6 to 4 times, for example, the explosive yield per unit weight as conventional explosives. This is an important military advantage, as the distance an aircraft, missile, or artillery piece can transport an explosive is inversely related to the explosive's weight. The greater yield of the explosives made according to embodiments of the present invention means that an aircraft, missile, or artillery piece will be able to deliver a much greater explosive force across their current operational range, or alternatively deliver their current destructive force across a significantly increased range.

Because elaborate safety precautions are not required in the manufacture of the separate components of explosives made according to embodiments of the present invention, they have the potential to be much cheaper than conventional explosives. For example, if a device is made by mixing gasoline (mostly octane) with $N_2O$, the components can be mixed in a ratio of 1 kg of gasoline to 9.6 kg of $N_2O$.

Explosives can be made by mixing $N_2O$ with existing widely available military logistic materials, including gasoline, kerosene, diesel fuel, jet fuel, or propane. $N_2O$ is an excellent oxidizer for use in bipropellant or hybrid rocket propulsion systems, and can be used as a monopropellant gas generator replacing highly toxic hydrazine in aircraft auxiliary power units (APUs). In addition, $N_2O$ can be decomposed catalytically to produce nitrogen and oxygen for breathing gas (for example, as described in U.S. Pat. No. 6,347,627 entitled "Nitrous Oxide Based Oxygen Supply System," the disclosure of which is hereby incorporated by reference in its entirety), a capability that could be of great use in a chemical or biological warfare battlefield, and it can also be used as a medical anesthetic.

As discussed above, embodiment of the present invention can be used to form weapons, such as bombs, mines, artillery shells, torpedoes, depth charges, missile warheads, or weapons that arm themselves after release from a weapons platform such as a ship, submarine, aircraft, missile launcher, howitzer, mortar, or cannon. Missile or torpedo systems may combine their propulsion systems to draw from a N2O reservoir that can also be used to form high explosives either before or after weapon discharge. Embodiments of the present invention can also be used for civil explosive for mining, blasting, and pyrotechnics.

While the methods disclosed herein have been described and shown with reference to particular operations performed in a particular order, it will be understood that these operations may be combined, sub-divided, or re-ordered to form equivalent methods without departing from the teachings of the present invention. Accordingly, unless specifically indicated herein, the order and grouping of the operations is not a limitation of the present invention.

While the invention has been particularly shown and described with reference to embodiments thereof, it will be understood by those skilled in the art that various other changes in the form and details may be made without departing from the spirit and scope of the invention.

The invention claimed is:

1. A military explosive device, comprising:

a portion of liquid nitrous oxide;

a first storage area containing said portion of nitrous oxide;

a portion of liquid fuel;

a second storage area containing said portion of fuel, wherein the ratio of nitrous oxide:fuel is from about 20:1 to about 5:1 by weight, wherein the nitrous oxide and fuel when mixed are miscible, wherein the first storage area selectively maintains the portion of nitrous oxide separated from the fuel in the second storage area prior to detonation of the explosive device, and mixing of the nitrous oxide and fuel to form an explosive mixture is (a) by a rupturable membrane or (b) by a normally closed valve located within conduit coupling the first and second storage areas, and wherein the explosive mixture is maintainable as a liquid prior to detonation of the device.

2. The explosive device of claim 1, wherein the first storage area is a tank for storing the portion of nitrous oxide.

3. The explosive device of claim 1, wherein the second storage area is a tank for storing the portion of fuel.

4. The explosive device of claim 1, wherein the second storage area includes a membrane for storing the portion of fuel.

5. The explosive device of claim 1, wherein the portion of fuel is selected from alcohols, paraffins, olefins, aromatics and mixtures thereof.

6. The explosive device of claim 1, wherein the nitrous oxide is stored in the first storage area.

7. The explosive device of claim 1, wherein the explosive device is a military weapon.

8. The explosive device of claim 1, wherein the explosive device is a pyrotechnic device.

9. The explosive device of claim 1, wherein the explosive device is a civil blasting explosive.

10. The explosive device of claim 1, further comprising:

a vent valve for discharging the nitrous oxide from the explosive device.

11. An explosive liquid mixture for use as a military device consisting essentially of liquid nitrous oxide and a liquid fuel, wherein the ratio of nitrous oxide:fuel is from about 20:1 to about 5:1 by weight, wherein the nitrous oxide and fuel are miscible, and wherein the nitrous oxide and fuel are mixed to form the explosive liquid mixture and the explosive mixture is maintainable as a liquid prior to detonation of the device.

12. The mixture of claim 11, wherein the fuel is selected from alcohols, paraffins, olefins, aromatics and mixtures thereof.

13. The mixture of claim 11, wherein the nitrous oxide is under high pressure.

14. The explosive device of claim 1, wherein the means for mixing includes a rupturable membrane positioned between the first and second storage areas.

15. The explosive device of claim 1, wherein the second storage area includes a membrane for storing the portion of fuel.

16. The explosive device of claim 14, wherein the membrane is capable of rupture at a pre-set time to initiate mixing between the first and second storage areas.

17. The explosive device of claim 14, wherein the membrane is capable of rupture upon acceleration of the explosive device to initiate mixing between the first and second storage areas.

18. The explosive device of claim 1, wherein the ratio of nitrous oxide:fuel is from about 20:1 to about 10:1 by weight.

* * * * *